US006004104A

United States Patent [19]

Rutherford

[11] Patent Number: 6,004,104

[45] Date of Patent: Dec. 21, 1999

[54] CATHODE STRUCTURE FOR SPUTTER ION PUMP

[75] Inventor: Sherman Rutherford, Portola Valley, Calif.

[73] Assignee: Duniway Stockroom Corp., Mountain View, Calif.

[21] Appl. No.: 08/892,507

[22] Filed: Jul. 14, 1997

[51] Int. Cl.[6] ..... F04B 37/02

[52] U.S. Cl. ..... 417/49

[58] Field of Search ..... 417/49

[56] References Cited

U.S. PATENT DOCUMENTS

| | | | |
|---|---|---|---|
| 2,993,638 | 7/1961 | Hall et al. | 417/49 |
| 3,070,283 | 12/1962 | Hall | 417/49 |
| 3,070,719 | 12/1962 | Jepsen | 313/7 |
| 3,091,717 | 5/1963 | Rutherford et al. | 313/181 |
| 3,141,986 | 7/1964 | Lloyd et al. | 313/7 |
| 3,147,910 | 9/1964 | Jepsen | 417/49 |
| 3,319,875 | 5/1967 | Jepsen | 417/49 |
| 3,452,923 | 7/1969 | Lamont, Jr. | 417/49 |
| 3,460,745 | 8/1969 | Lamont, Jr. | 417/49 |
| 3,546,510 | 12/1970 | Klopfer et al. | 313/7 |
| 3,574,569 | 4/1971 | Vordahl | 428/588 |
| 4,631,002 | 12/1986 | Pierini | 417/49 |

*Primary Examiner*—John J. Vrablik
*Attorney, Agent, or Firm*—Flehr Hohbach Test Albritton & Herbert LLP

[57] ABSTRACT

A sputter ion pump including an anode assembly comprising a plurality of hollow anode cells and cathode surfaces having open spirals disposed at each end of said anode cells.

9 Claims, 3 Drawing Sheets

CATHODE STRUCTURE FOR SPUTTER ION PUMP

BRIEF DESCRIPTION OF THE INVENTION

This invention relates generally to sputter ion pumps and more particularly to an improved cathode structure.

BACKGROUND OF THE INVENTION

In sputter ion pumps a glow discharge produces positive ions which are accelerated by an electric field and bombard or react with a cathode structure to sputter off cathode particles. The sputtered particles condense on other surfaces of the cathode, anode or other surfaces of the ion pump. The condensed cathode material entraps ions through the various entrapment mechanisms; as a result pressure within the pump is reduced. The entrapment mechanisms include: 1. Chemical combination for chemically active gases such as oxygen and nitrogen; 2. Burial and diffusion for small gas molecules such as hydrogen and helium; 3. Burial and covering over with further sputtered deposits. The ion covering or capturing mechanism is particularly suitable for pumping noble gasses such as argon, neon, krypton and the like.

The structure and operation of sputter ion pumps is well known. U.S. Pat. No. 2,993,638 relates to an ion pump in which the sputtering is enhanced by employing closely spaced louvers which are disposed at grazing or glancing angles with respect to the incident impinging ions. U.S. Pat. No. 3,319,875 discloses a sputter cathode composed of a number of concentrically disposed frusto-conical members of increasing radius opposite and coaxial with cylindrical anodes. U.S. Pat. No. 3,091,717 discloses a sputter cathode grid formed by affixing one or more spiral tapes onto a cathode plate as, for example, by spot welding or brazing. A plug is disposed at the center of the spiral cathode for providing sputter particles at the intense region of the glow discharge, thereby increasing the life of the cathode structure. U.S. Pat. No. 4,631,002 discloses a sputter ion pump which includes a plurality of cylindrical hollow anode cells arranged between two cathodes. The cathodes are formed with inwardly extending blades arranged radially adjacent each of the anode cells, and provide an increased sputter surface. In addition, the construction is such that the cathodes can be easily manufactured by punching and the like.

Two electrical configurations of sputter-ion pumps are disclosed in these patents. One, the "diode" configuration, applies positive high voltage to the anode structure and maintains the cathode plates at ground potential. The other, the "triode" configuration, applies a negative high voltage to the cathode plates and maintains the anode structure at ground potential.

It is desirable to provide cathode structures which have large sputtering areas; which are arranged for grazing incidence of ions for high sputtering rates; which generate substantial areas shadowed from sputtering, which are useful in both "diode" and "triode" configurations and are easy and inexpensive to fabricate.

OBJECTS AND SUMMARY OF THE INVENTION

It is a general object of the present invention to provide a sputter ion pump having a cathode structure with spiraled strips presenting grazing incidence sputtering surfaces disposed coaxially with respect to cylindrical anodes.

It is another object of the present invention to provide a cathode having large sputtering areas arranged in grazing incidence of ions with large surface areas shadowed from sputtering.

It is a further object of the present invention to provide a spiral cathode structure useful in diode and triode ion pumps.

It is another object of the present invention to provide an easy to fabricate, inexpensive cathode assembly for sputter ion pumps.

A sputter ion pump in accordance with the present invention includes two spaced cathodes on each side of hollow cylindrical anode cells, characterized in that at least one of the cathodes has a plurality of areas composed of open spirals located adjacent the ends of each of said anodes with the centers of the spirals on axis with the cylindrical anodes.

BRIEF DESCRIPTION OF THE DRAWINGS

The foregoing and other objects of the invention will be more clearly understood from the following description when read in connection with the accompanying drawings of which.

DESCRIPTION OF THE PREFERRED EMBODIMENT

Figure 1:
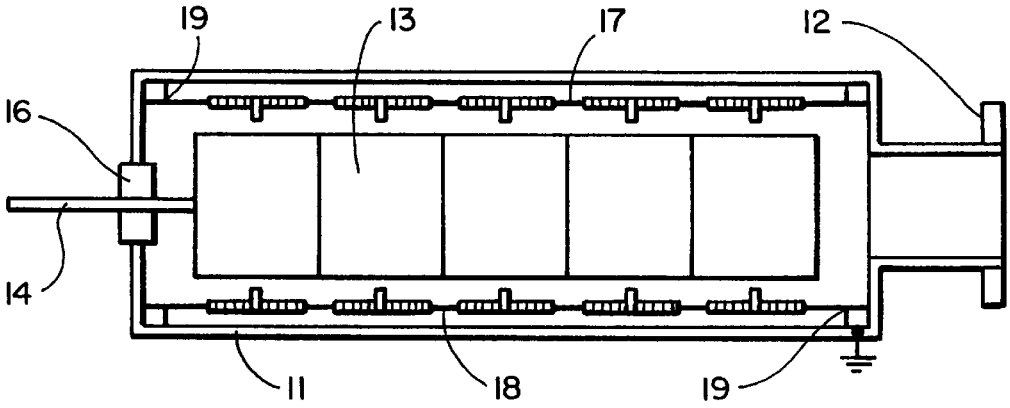
FIG. 1 is a schematic cross-sectional view of a diode sputter ion pump incorporating cathodes in accordance with the present invention.
Figure 2:
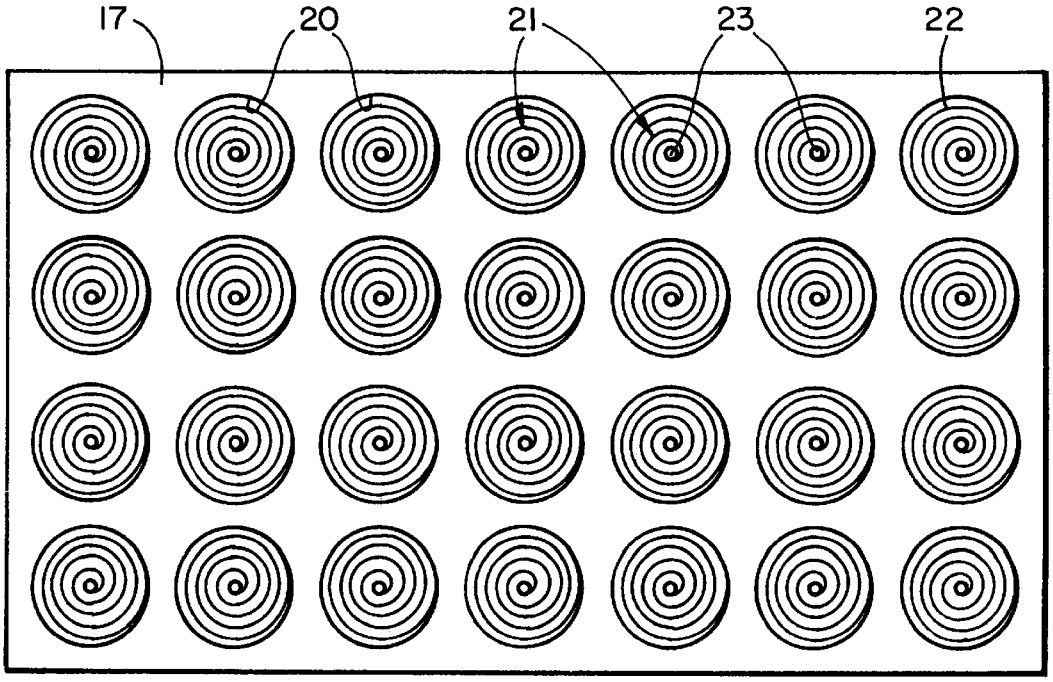
FIG. 2 is a plan view of one of the cathodes shown in FIG. 1.

A sputter ion pump incorporating a cathode structure in accordance with the present invention is schematically illustrated in FIGS. 1 and 2. The pump includes a rectangular envelope 11 adapted to be connected to a system to be evacuated by a flange 12, a cellular anode assembly 13 is disposed within the rectangular envelope. The cellular anode assembly may, for example, comprise a plurality of circular cylindrical members joined to one another and supported within the envelope by conductive rod 14. The rod 14 extends through the envelope 11 and is supported from the envelope by an insulating support 16. A cathode assembly 17, 18 in accordance with one embodiment of the present invention is disposed on each side of the anode assembly.

In operation, a positive potential of between 3 kv and 7 kv is applied to the anode, while the cathode and envelope are maintained at ground potential. A magnetic field is provided parallel to the axis of the cylindrical anodes. The high voltage between the anode assembly and the cathode produces electrical breakdown of the gasses within the envelope to form a glow discharge between the individual anodes and the cathodes. The magnetic field causes the glow discharge to form a column. Positive ions produced in the glow discharge strike the cathode, which in the preferred embodiment are made of a getter material such as titanium. The ionized molecules striking the surface of the cathode are neutralized and cause sputtering of the titanium. The sputtered titanium particles collect on the unexposed surfaces of the cathode, the anode and the envelope. Noble gasses are pumped by being buried or covered over by the titanium particles or titanium compounds as they deposit on the surfaces. This results in pumping of the noble gasses such as argon, neon, krypton and xenon. Since argon makes up about one percent of air, it can give rise to argon instability when using flat cathode plates because argon molecules previously covered over are subsequently re-emitted by further sputtering. The problem has been overcome in the prior art by providing cathode slats, blades, et cetera, which present angled surfaces which allow the ions to grazingly collide with the cathode surfaces increasing the yield of sputter material. In addition, these structures provide increased areas which are subject to buildup of sputtered material but not subject to continued sputtering for better implantation on the surfaces of the envelope and associated elements. As a result of these improvements, stable pumping of argon and other noble gasses can be sustained.

Figure 3:
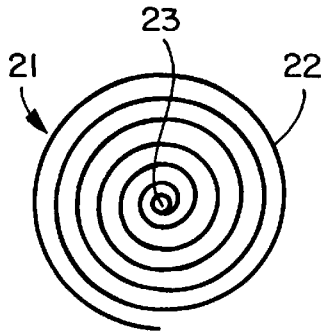
FIG. 3 shows a cathode spiral with a center post.
Figure 4:
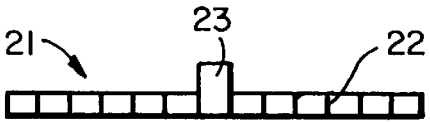
FIG. 4 is a side elevation view of the cathode spiral shown in FIG. 3.

The improved cathode structure in accordance with the preferred embodiment of the present invention comprises plates 17 and 18 maintained in spaced relationship by spacers 19. The plates have a plurality of punched holes 20 arranged opposite the cylindrical anodes 13. The example shown illustrates a pump with square-packed anode cells. It could equally be used with a pump having close-packed anode cells and appropriately arranged spirals. Spirals 21 of titanium material are inserted into the punched holes and fastened to the plates 17 and 18 by spot welding or arc welding. Suitable spiral cathode elements are shown in FIGS. 3 and 4. The elements include a strip 22 secured at one end to a solid rod or mandrel 23 made of suitable material such as titanium or tantalum onto which is wound a titanium strip to form a spiral 21. For example, the thickness of the strip material may be between 0.015 and 0.050 inches with the strip width being between 0.05 and 0.2 inches. The wound spiral has an open area-to-strip thickness ratio of between 0.5 and 3.0. The spiral-wound cathodes provide a large grazing sputtering surfaces from which the sputtered particles can easily travel to the walls of the envelope and to the intended shadowed areas of the spirals for deposit and inert gas molecule trapping. The center post may have a diameter of between 0.050 and 0.25 inches and a height between 0.05 and 0.5 inches. The center post provides additional material at the point of maximum ion bombardment concentration whereby to provide prolonged cathode life. The cathode assembly in accordance with the present invention is simple and inexpensive to fabricate.

Figure 5:
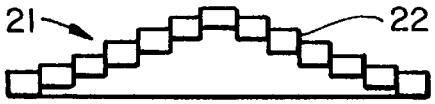
FIG. 5 is a side elevational view of a distended cathode spiral.

In another embodiment, the central-most coils of the spiral cathode member can be distended as shown in FIG. 5 and arranged so that the extending portion is directed into the anodes to provide improved sputtering action at the region of intense ion bombardment.

Figure 6:
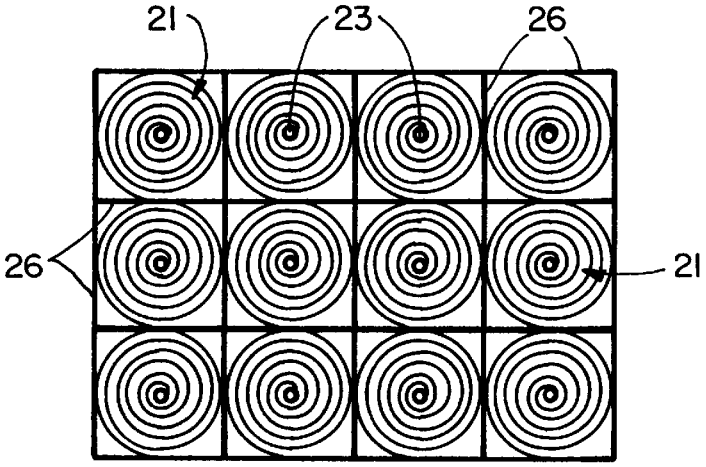
FIG. 6 shows a square-packed spiral cathode assembly.
Figure 7:
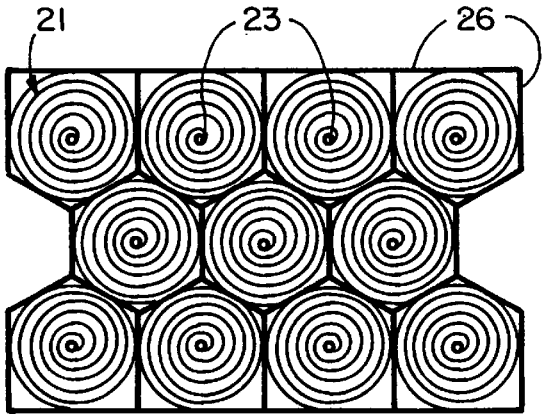
FIG. 7 shows a close-packed spiral cathode assembly.

Rather than supporting the cathode structure with a plate 17, 18 the array of spirals can be supported in a grid formed by strips of material 26 such as for example titanium or stainless steel interposed with the spiral arrays. The interspersed strips 26 are spot welded or heli-arced or brazed to the adjacent spirals. FIG. 6 shows such a structure arranged in a square-packed anode array, while FIG. 7 shows such a structure position relation to a close-packed anode array.

Figure 8:
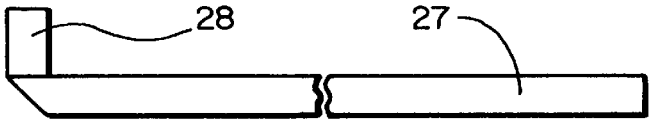
FIG. 8 shows another method of constructing a cathode strip prior to formation of a spiral cathode.

FIG. 8 shows another embodiment of a strip 27 of the type used to form the spiral cathodes. In FIG. 8 the strip includes a projecting portion 28, produced, for example, by folding the strip, around which the remainder of the strip can be spirally wound.

Figure 9:
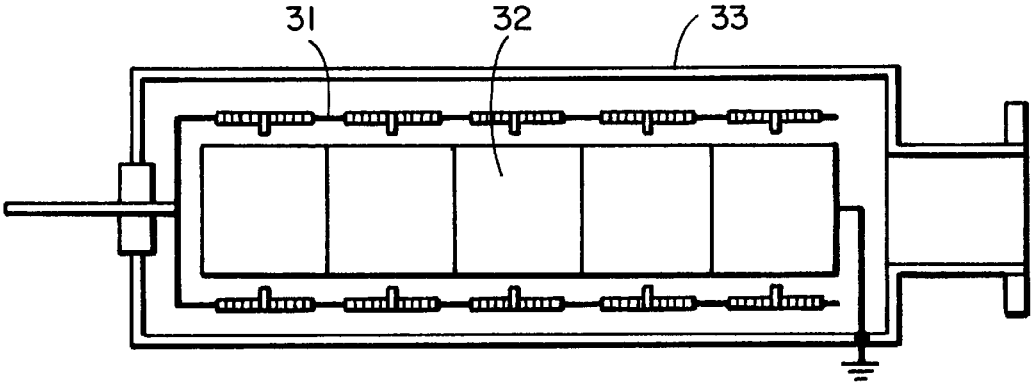
FIG. 9 schematically illustrates a triode configuration sputter ion pump incorporating cathodes in accordance with the present invention.

In FIG. 9 there is shown a triode assembly in which the cathodes 31 operate substantially as described above. In this assembly, the anode structure 32 is grounded while the cathode structure 31 is held at a high negative voltage with respect thereto and with respect to the grounded envelope 33.

Thus, there has been provided an improved sputter ion vacuum pump and cathode assembly.

I claim:

1. A sputter ion pump comprising an evacuated envelope with spaced cathodes of getter material, and an anode having a plurality of hollow cells disposed between said cathodes within said envelope, characterized in that at least one of the cathodes comprises open support means for supporting a plurality of open spirals formed with strips of getter material, one of said open spirals being located opposite the end of each of said anodes to provide a plurality of gas discharge paths through said open spirals within said envelope.

2. A sputter ion pump as in claim 1 in which each of said cathodes includes a cathode plate with openings opposite the end of each of said anodes and said open spirals are supported within said openings.

3. A sputter ion pump as in claim 1 in which each of said cathodes comprises a grid formed of strips of material and said open spirals are supported by said grid.

4. A sputter ion pump as in claim 1 in which the anode cells are cylindrical and the open spirals are co-axial with the anode cells.

5. A sputter ion pump as in claim 4 in which the spirals are distended with the distended center extending toward the adjacent anode cell.

6. A sputter ion pump as in claims 1, 2, 3, 4 or 5 in which the spirals are wound onto a center post.

7. A sputter ion pump as in claims 1, 2, 3, 4 or 5, in which the anode structure is maintained at positive high voltage and the cathode plates are at ground potential.

8. A sputter ion pump as in claims 1, 2, 3, 4 or 5, in which the cathode structures are maintained at a negative high potential and the anode structure is at ground potential.

9. A sputter ion pump as in claim 1, 2, 3, 4 or 5 in which the thickness of the strip material is between 0.015 and 0.050 inches, the strip width is between 0.05 and 0.2 inches, and the wound spiral has an area-to-strip thickness ratio of between 0.5 and 3.0.

* * * * *